US005203407A

United States Patent [19]

Nagasaka

[11] Patent Number: 5,203,407

[45] Date of Patent: Apr. 20, 1993

[54] VEHICLE-LOADED PARALLEL FLOW TYPE HEAT EXCHANGER

[75] Inventor: Yoshikiyo Nagasaka, Saitama, Japan

[73] Assignee: Zexel Corporation, Tokyo, Japan

[21] Appl. No.: 788,837

[22] Filed: Nov. 7, 1991

[30] Foreign Application Priority Data

Nov. 7, 1990 [JP] Japan ..... 2-301404

[51] Int. Cl.[5] ..... F28F 9/02

[52] U.S. Cl. ..... 165/174; 165/175; 165/176

[58] Field of Search ..... 165/174–176

[56] References Cited

U.S. PATENT DOCUMENTS 2,419,575 4/1947 Leonard ..... 165/176 X

FOREIGN PATENT DOCUMENTS 943948 5/1956 Fed. Rep. of Germany ..... 165/174
2930577 2/1981 Fed. Rep. of Germany ..... 165/176
55-28476 2/1980 Japan ..... 165/176
63-3191 1/1988 Japan ..... 165/176
2-259378 10/1990 Japan ..... 165/174

*Primary Examiner*—Allen J. Flanigan
*Attorney, Agent, or Firm*—Kanesaka & Takeuchi

[57] ABSTRACT

A heat exchanger includes a pair of header tanks (4) placed in parallel to each other in a plane; a row of parallel tubes (2) placed in the plane and connected at opposite ends to the header tanks; a plurality of partitions (6, 6') provided in the header tanks to divide each header tank into a plurality of compartments (8a) along the length of the header tank thereby forming a plurality of refrigerant passages (2A, 2B) each consisting of a plurality of multitube paths each having a plurality of the parallel tubes; and a pair of additional tanks (7) each attached to each of the header tanks to form a chamber (8) which communicates with the refrigerant passages through ports formed on the header tank whereby refrigerant is distributed into the plurality of refrigerant passages to provide the reduced flow resistance of refrigerant.

9 Claims, 12 Drawing Sheets

VEHICLE-LOADED PARALLEL FLOW TYPE HEAT EXCHANGER

BACKGROUND OF THE INVENTION

1. Field of the Invention

The present invention relates to a heat exchanger of the parallel flow type including a plurality of tubes extending in parallel with one another and stacked one on another and header tanks connected to laterally opposite ends of the tube stack. (See Diesel Kiki Col, Ltd. U.S. Pat. No. 5,036,914.)

2. Prior Art

The automotive parallel flow type heat exchanger generally comprises a plurality of tubes and fins stacked together one on another alternately, header tanks connected to laterally opposite ends of such a stack, and an inlet pipe connected to one header tank and an outlet pipe connected to the other header tank.

All the tubes constitute together a single passage between the headers so that heat exchanging medium (referred to hereinafter as refrigerant) may flow in parallel and in one pass (See Japanese Utility Model Application Disclosure Gazette No. 63(1988)-74970) or each header tank is provided therein with partitions to define a refrigerant passage folded plural times in zigzag fashion (See Japanese Patent Application Disclosure Gazette No. 63(1988)-34466).

However, such heat exchanges of the prior art inevitably enlarge the volume of each header tank since refrigerant flows through a single passage between the opposite headers whether this single passage is straight or in serpentine fashion. With such arrangement, the distribution of refrigerant from the header tank into the respective tubes smoothly occurs when the flow rate of refrigerant is relatively high, but the flow resistance within each header tank increases as the flow rate of refrigerant decreases down to medium or low levels and correspondingly the distributing efficiency as well as the heat exchanging efficiency is lowered.

Recently, the capacity-variable compressor has often been employed in a refrigerant cooling system and, accordingly, there is a serious need to achieve the maximum efficiency of the heat exchanger even during the low capacity operation.

Thus, a principal object of the present invention is to provide a heat exchanger with an improved heat exchanging efficiency in which the distribution of refrigerant to each tube is improved not only at high flow rates of refrigerant but also at medium or low flow rates of refrigerant. (For this object, see the U.S. Pat. No. 5,036,914, too.)

SUMMARY OF THE INVENTION

Accordingly, it is a principal object of the present invention to provide a heat exchanger adapted to improve the distributing efficiency and therefore the heat exchanging efficiency not only at high flow rates of refrigerant but also at a medium or low flow rate of refrigerant.

The object set forth above is achieved, according to a first aspect of the invention, by a heat exchanger of the parallel flow type including a plurality of tubes extending in parallel with one another and stacked one on another and header tanks connected to laterally opposite ends of the tube stack, said heat exchanger being characterized in that there are provided within said header tanks partitions to divide said tubes into a plurality of passages and that separate members are provided externally of the header tanks, respectively, so as to form free spaces serving for distribution and/or collection of refrigerant, which are, in turn, in communication with said plurality of passages. According to a second aspect of the invention, there is provided a heat exchanger of parallel flow type including a plurality of tubes extending in parallel with one another and stacked one on another and header tanks connected to laterally opposite ends of the tube stack, said heat exchanger being characterized in that there are provided within said header tanks partitions to divide said tubes into a plurality of passages and that the header tanks are provided therein with free spaces serving for distribution and/or collection of refrigerant integrally with and longitudinally of the header tanks so that these free spaces are in communication with said respective passages through communication ports.

BRIEF DESCRIPTION OF THE INVENTION

FIGS. 1 through 4 illustrate a first embodiment of the invention, in which:

FIG. 1 is a perspective view of the heat exchanger;

FIG. 2 is a schematic front view of the heat exchanger;

FIG. 3 is a transverse sectional view of the header tank; and

FIG. 4 is a fragmentary sectional view of a mechanism by which the tank is joined to the tank member;

FIGS. 6 through 9 illustrate a third embodiment of the invention; in which FIG. 6 is a transverse sectional view of the header tank;

FIG. 7 is a longitudinal sectional view of the header tank; and

FIGS. 8 and 9 are plan views illustrating the partitions, respectively;

FIGS. 13 and 14 illustrate a seventh embodiment of the invention, in which:

FIG. 13 is a transverse sectional view of the header tank; and

FIG. 14 is a schematic front view of the heat exchanger;

FIGS. 16 and 17 illustrate an eighth embodiment of the invention, in which:

FIG. 16 is a transverse sectional view of the header tank; and

FIG. 17 is a schematic front view of the heat exchanger; and

DETAILED DESCRIPTION OF PREFERRED EMBODIMENT

Figure 1:
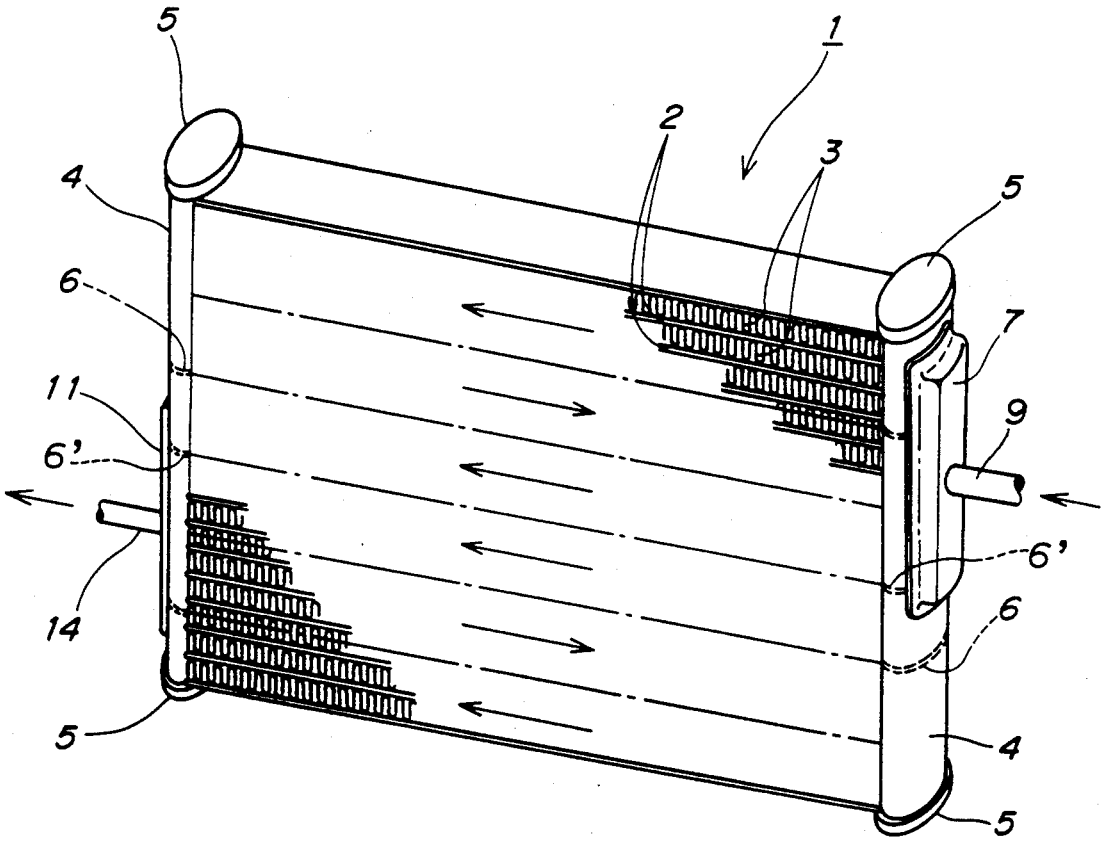

The first embodiment of the present invention will be described in reference with FIGS. 1 through 4.

A heat exchanger 1 according to this embodiment comprises, a plurality of flat tubes 2 and corrugated fins 3 extending in parallel to one another and stacked together one on another alternately to form a stacked tube assembly and a pair of header tanks 4 connected to opposite ends of the stacked assembly, respectively.

Figure 2:
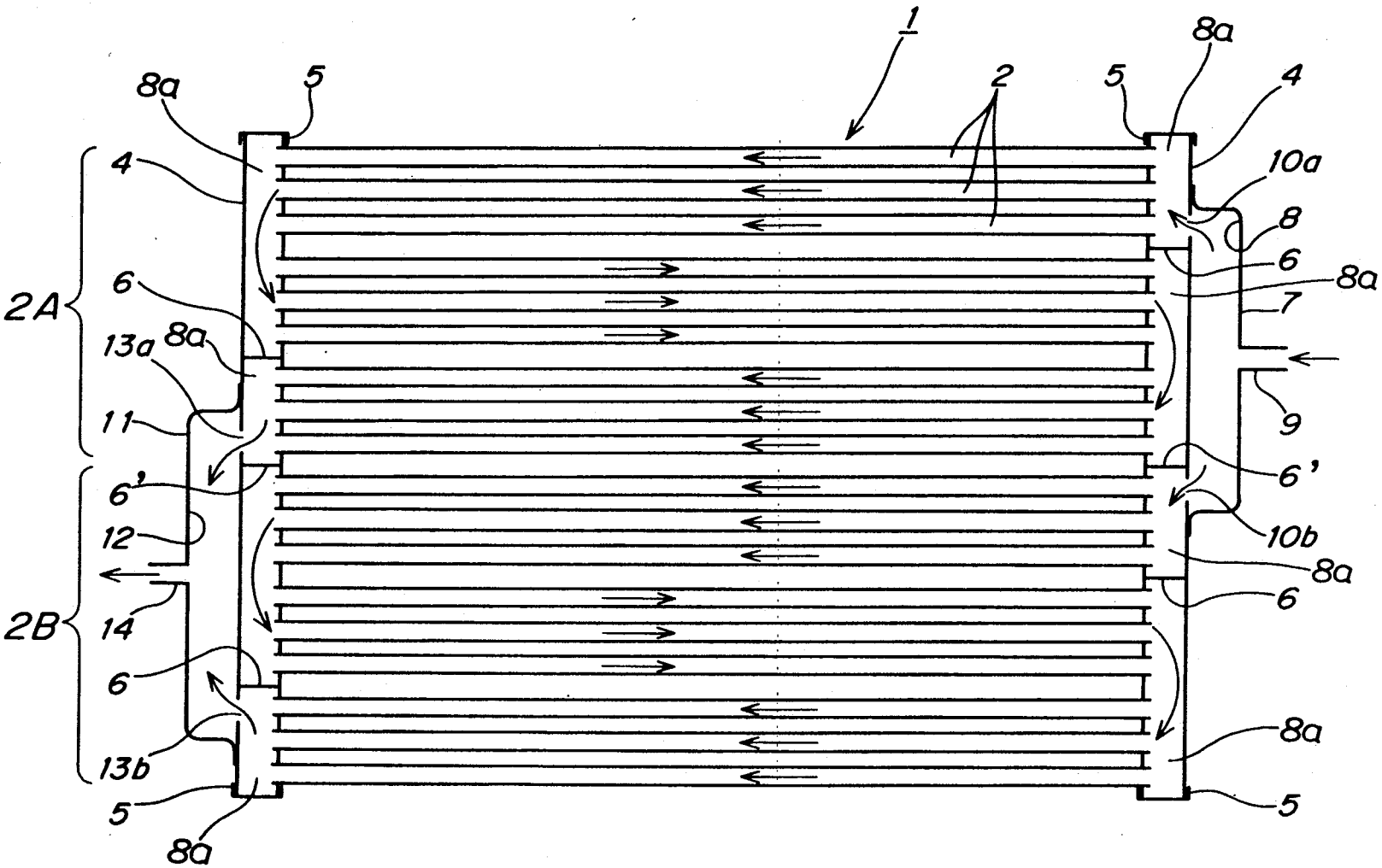
Figure 3:
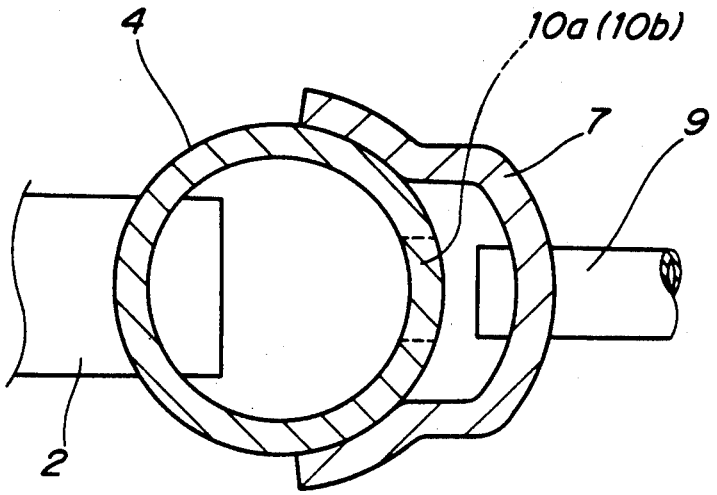

Each header 4 comprises a round tubular pipe having its vertically opposite ends closed by blind caps 5, respectively. As best shown in FIG. 2, the respective header tanks 4 are provided therein with three partitions 6 and 6' per tank to define four compartments 8*a* and upper and lower passages 2A, 2B for refrigerant separated from each other in the heat exchanger 1. In this embodiment, each of these passages 2A, 2B comprises three paths each consisting of three flat tubes 2 and is twice folded in zigzag fashion between the opposite header tanks 4.

The header tank 4 on the inlet side (i.e., right side as viewed in FIG. 2) is provided with a tank member (a separate member) 7 which defines on the outer side of this header tank 4 a refregerant distributing chamber (free space) 8. An inlet pipe 9 is connected to the tank member 7 and the distributing chamber 8 is in communication with the above-mentioned pair of refrigerant passages 2A, 2B through respective communication ports 10*a*, 10*b* provided in the header tank 4.

The header tank 4 on the outlet side (i.e., left side as viewed in FIG. 2) is provided, on the other hand, with a tank member (separate member) 11 which defines on the outer side of this header tank 4 a refrigerant collecting chamber (free space) 12. The refrigerant collecting chamber 12 is in communication with said pair of refrigerant passages 2A, 2B through respective communication ports 13*a*, 13*b* provided in this header tank 4, and an outlet pipe 14 is connected to the tank member 11.

Figure 4:
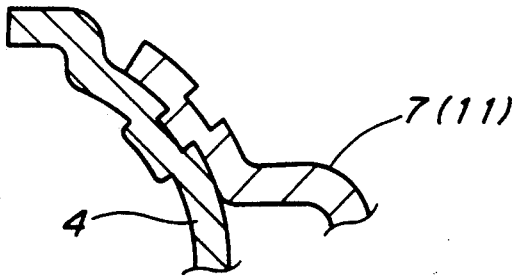

As best shown in FIG. 4, the respective tank members 7, 11 are integrally joined to the associated header tanks 4 by emboss-engagement and brazing in concave-convex shape.

With such a heat exchanger 1, some of the refrigerant introduced through the inlet pipe 9 into the distributing chamber 8 as indicated by an arrow in FIG. 2 flows into the upper refrigerant passage 2A through the communication port 10*a* and the rest of the refrigerant into the lower refrigerant passage 2B through the other communication port 10*b*.

The refregerant having passed through the upper refrigerant passage 2A then flows through the communication port 13*a* into the collecting chamber 12 and the refrigerant having passed through the lower refrigerant passage 2B then flows through the communication port 13*b* into said collecting chamger 12, both the portions of refrigerant being discharged from the collecting chamger 12 through the outlet pipe 14.

In this manner, a half of the refrigerant is distributed into the upper refrigerant passage and the other half into the lower refrigerant passage. Consequently, the refrigerant flow resistance in each header tank can be correspondingly reduced allowing the capacity of the header tank to be reduced. In addition, the reduction of the flow resistance improves a heat exchanging efficiency. Furthemore, the reduced header tank capacity improves efficiency of refrigerant distribution from the header tanks into the respective flat tubes even during medium or low capacity operation of the heat exchanger thereby improving the performance of the heat exchanger during its medium or low capacity operation.

Now the second embodiment will be described.

Figure 5:
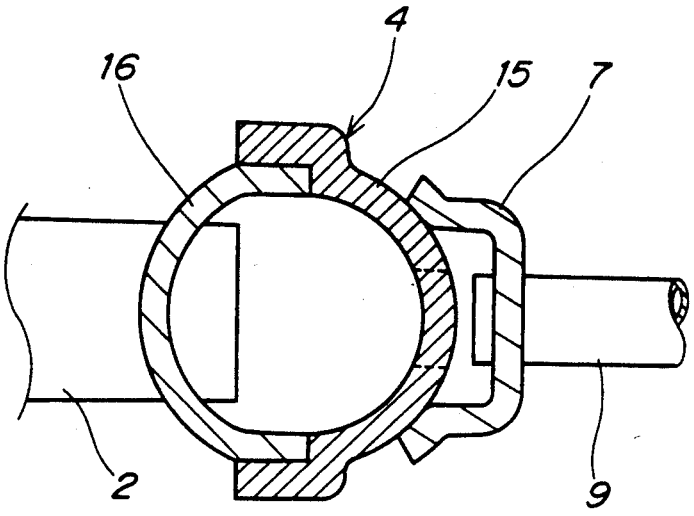
FIG. 5 is a transverse sectional view of the header tank in a second embodiment of the invention.

With the heat exchanger according to this specific embodiment, as will be apparent from FIG. 5, each header tank 4 is divided into a tank 15 and an end plate 16, and the tank member 7 is joined to the outer side of the tank 15. Accordingly, not only the same effect as achieved by the previously mentioned embodiment is achieved, but also working is facilitated since the header tank can be obtained by press forming.

The third embodiment will be descrbied.

Figure 6:
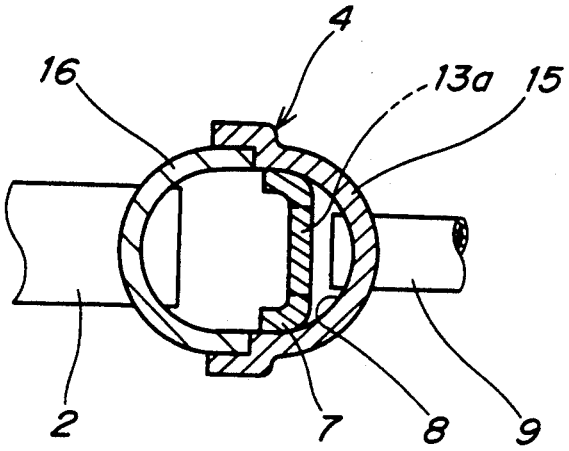

With the heat exchanger according to this embodiment too, each header tank 4 is, as shown by FIG. 6, diametrically divided into the tank 15 and the end plate 16, and the tank member 7 is provided within the header tank 4.

Figure 7:
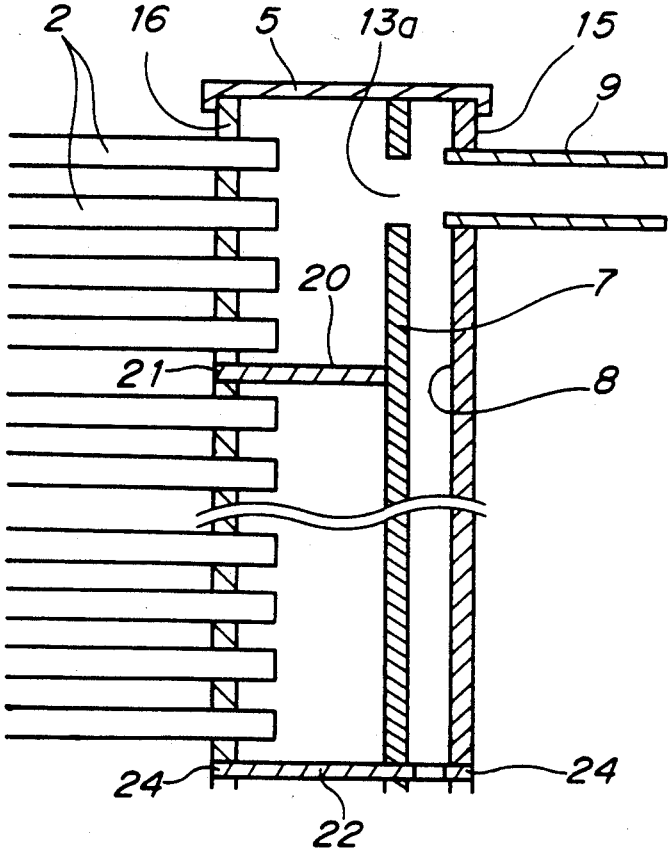

More specifically, the tank member 7 and the tank 15 define therebetwen the distributing chamber 8 and the collecting chamber (now shown) both extending within the header tank 4 longitudinally thereof. Referring to FIG. 7, the inlet pipe 9 and the outlet pipe (not shown) are connected to the tank 15 and the tank member 7 is provided with the communication ports 13*a*, 13*b* which are in communication with the refrigerant passages 2A, 2B, respectively.

Figure 8:
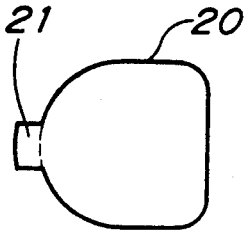
Figure 9:
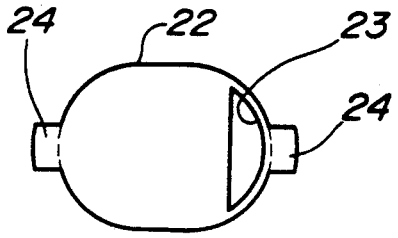

It should be understood that the distributing chamber, the collecting chamber and the header tanks are longitudinally compartmentalized by partitions such as shown in FIGS. 8 and 9.

A partition 20 shown by FIG. 8 is configured so as to block the header tank 4 (except the distributing chamber and the collecting chamber) and provided with an insertion projection 21 adapted to be locked into an associated insertion hole formed through the end plate 16.

A partition 22 with a cutout 23 as shown by FIG. 9 is configured so as to conform with the interior of the header tank 4 and provided at a location corresponding to the distributing or collecting chamber. Reference numeral 24 designates an insertion projection.

The fourth embodiment will be described.

Figure 10:
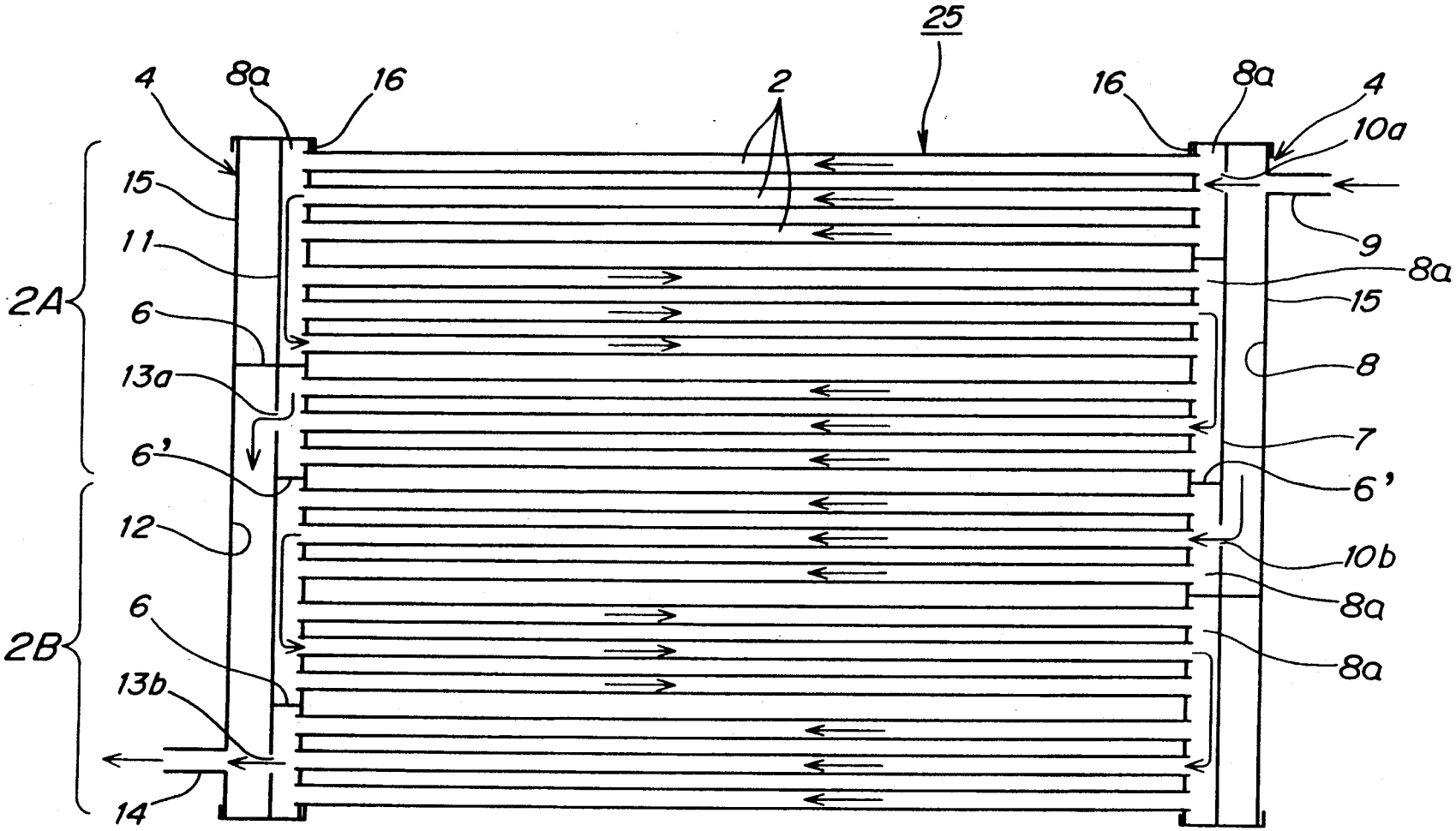
FIG. 10 is a schematic front view of the heat exchanger according to a fourth embodiment of the invention.

As will be apparent from FIG. 10, a heat exchanger 25 according to this embodiment includes the distributing chamber 8 and the collecting chamber 12 formed within the header tank 4 in the same manner as shown by FIG. 6, and the refrigerant passages 2A, 2B, each comprising three paths, on upper and lower sides of the heat exchanger 25, respectively. Accordingly, this embodiment provides the effect similar to that provided by the third embodiment as has been described above.

Then, the fifth embodiment will be explained.

Figure 11:
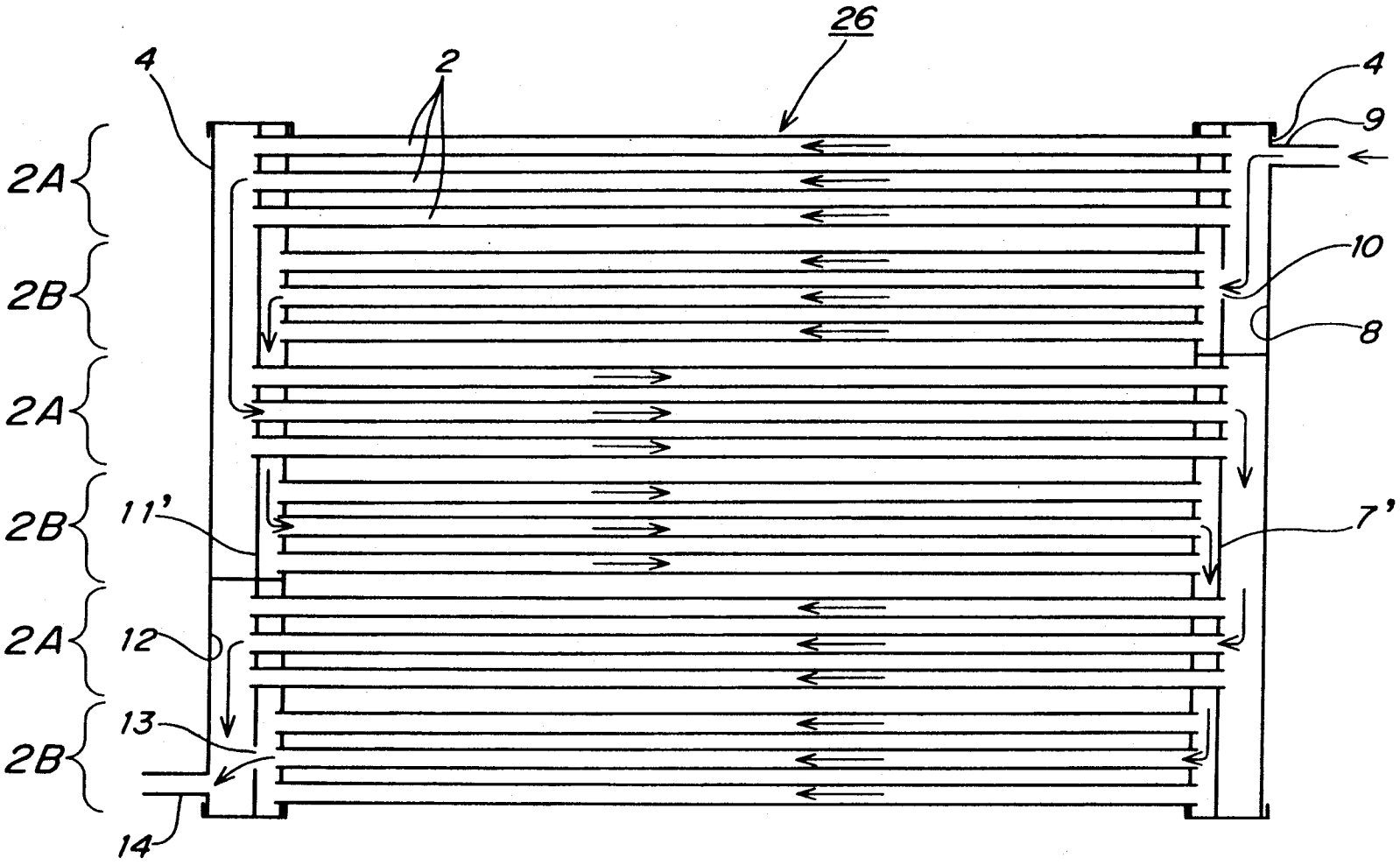
FIG. 11 is a schematic front view of the heat exchanger according to a fifth embodiment of the invention.

Referring to FIG. 11, a heat exchanger 26 according to this embodiment employs the header tanks 4 as shown by FIG. 5 and a pair of refrigerant passages 2A, 2B each comprising three paths but alternately stacked one on another. Consequently, a group of flat tubes 5 constitutes each path of one refrigerant passage 2A which is in communication with both the distributing chamber 8 and the collecting chamber 12, and refrigerant flows through the respective refrigerant passages 2A, 2B as indicated by arrow. Accordingly, this embodiment provides, an addition to the effect similar to that provided by the previously mentioned embodiments, an advantage that the respective heat exchanging efficiencies of both the passages 2A, 2B can be equalized when loaded on a vehicle of the down-nose type. Reference numerals 10, 13 designate communication ports but only one port is sufficient for the inlet or outlet pipe 9 or 14 in this case.

The sixth embodiment will be described.

Figure 12:
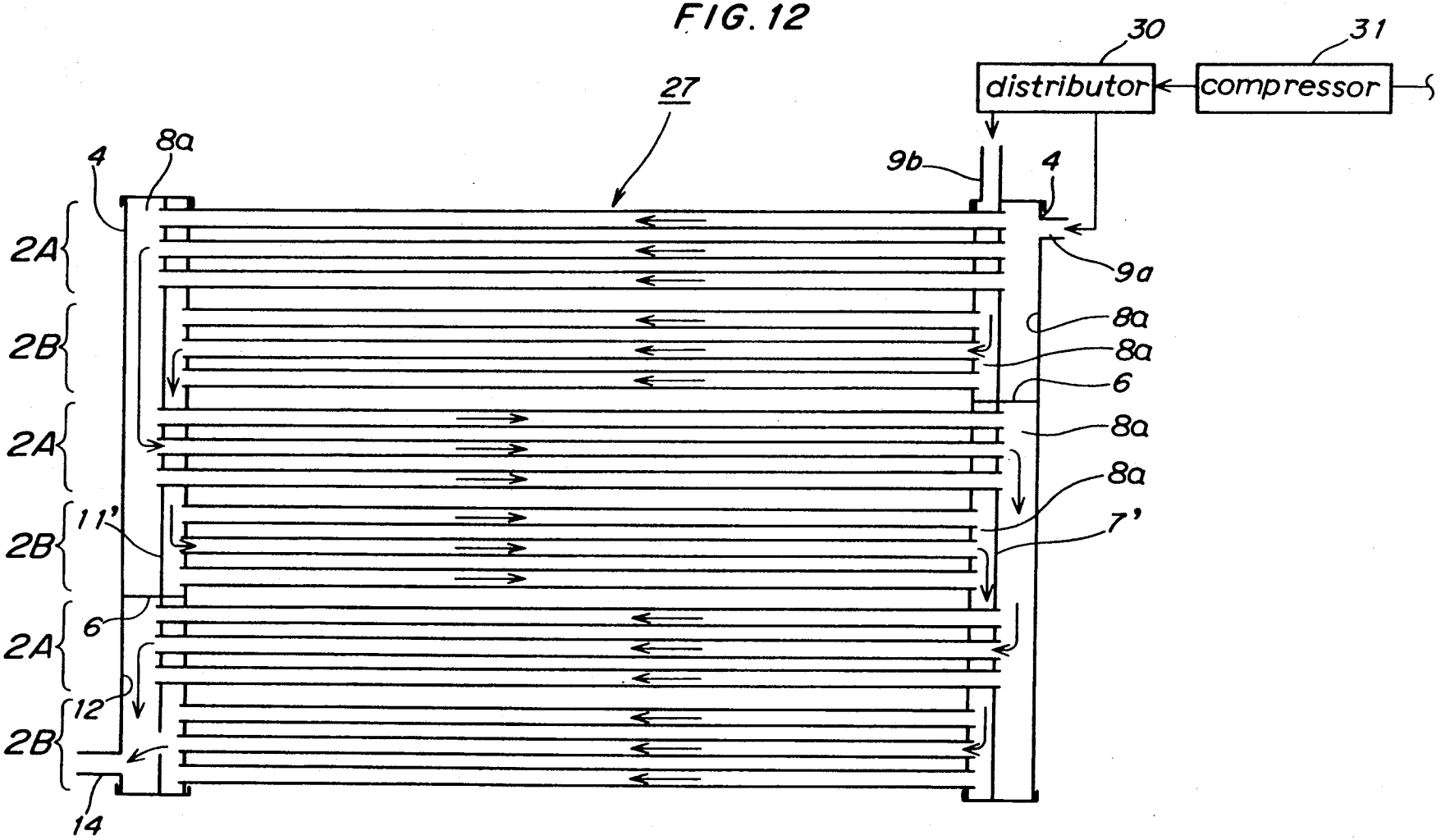
FIG. 12 is a schematic front view of the heat exchanger according to a sixth embodiment of the invention.

Referring to FIG. 12, in a heat exchanger 27 according to this embodiment, three flat tubes 2 constitute each path of one passage 2A which is in communication with the spaces 8*a* defined by the tank members 7' and the header tanks 4 while three flat tubes 2 constituting each path of the other passage 2B are in communication with the header tanks 4. The header tank 4 on the inlet side is provided with inlet pipes 9*a*, 9*b* adapted to be in communication with the space 8*a* and the interior space 8*a* of this header tank 4, respectively. A capacity-variable compressor 31 is connected to the inlet pipes 9*a*, 9*b* via a distributor 30.

When the compression capacity of the compressor 31 is low, a switching valve of the distributor 30 operates to limit the flow of refrigerant to only one refrigerant passage 2A.

Consequently, this embodiment allows the capacity to be varied depending on the volume of refrigerant.

The seventh embodiment will be described.

Figure 13:
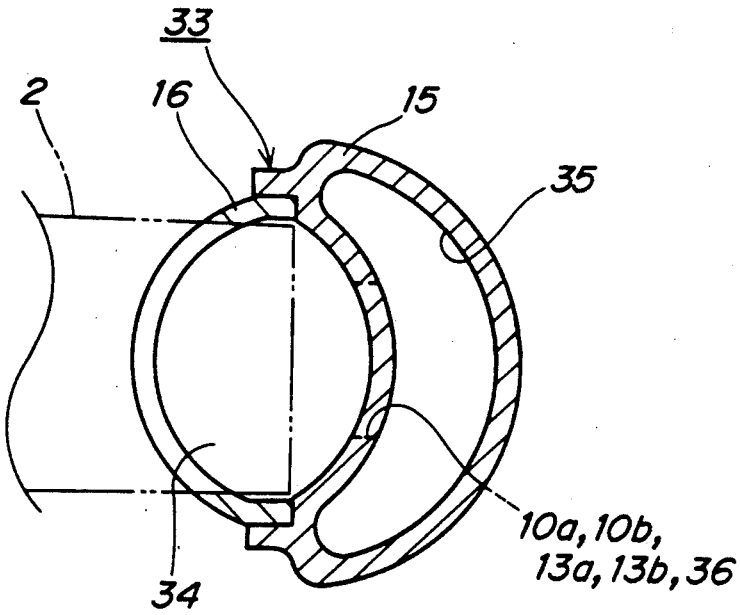
Figure 15:
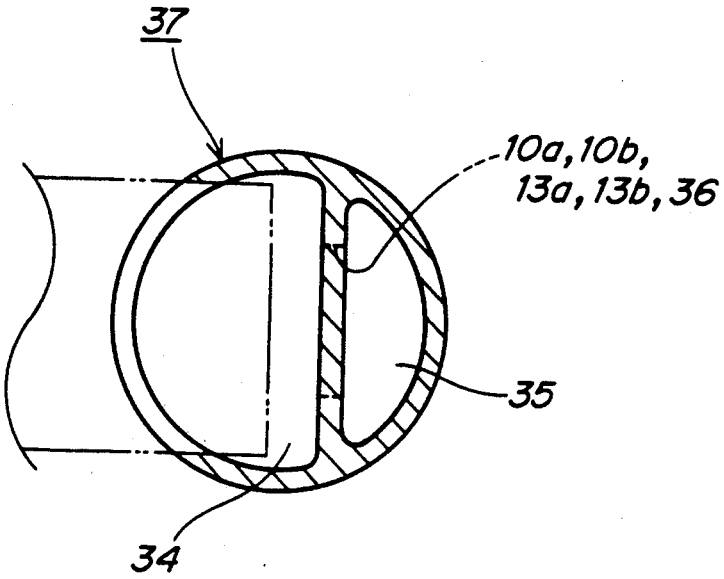
FIG. 15 is transverse sectional view illustrating a variant of the header tank.
Figure 14:
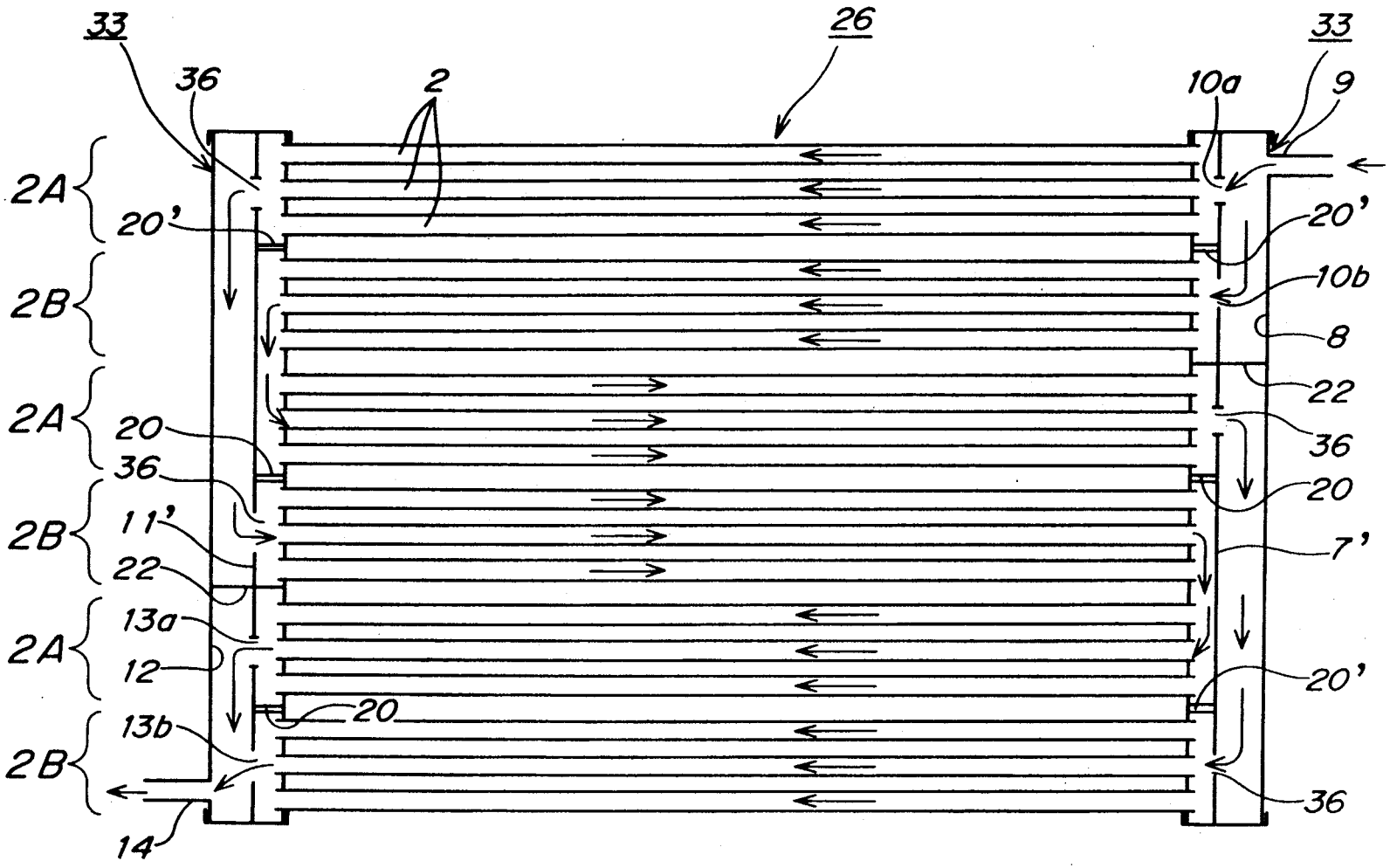

According to this embodiment, each header tank 33 comprises, as shown by FIG. 13, the diametrically divisible end plate 16 and tank 15 which may be joined together to form an axial main passage 34. Said tank 15 is formed by extrusion so as to define therein an axial sub-passage (free space) 35. These main- and sub-passages 34, 35 are in communication with each other through communication ports 10*a*, 10*b*, 13*a*, 13*b* provided at desired locations. An alternative the header tank may be a header tank 37 is obtained by extrusion so as to form the main- and sub-passages 34, 35 integrally within a single round tubular pipe, as shown by FIG. 15. Referring to FIG. 14, the inlet pipe 9 is connected to the inlet header tank 33 at a location adjacent its upper end while the outlet pipe 14 is connected to the outlet header tank 33 at a location adjacent its lower end. Both header tanks 33 are provided at desired locations with the partitions 20, 22 and 20' to form two sets of refrigerant passages each set comprising three paths and the wall 7' partitioning the main- and sub-passages 34, 35 is provided at desired locaiton with communication ports 36. According to this embodiment, the distributing chamber 8 is defined in an upper portion of the inlet header tank 33 and the collecting chamber 12 is defined in a lower portion of the outlet header tank 33.

Refrigerant introduced through the inlet pipe 9 into the distributing chamber 8 then flows, as indicated by arrows in FIG. 14, through the communication ports 10*a*, 10*b* into the refrigerant passages 2A, 2B, respectively, while refrigerant thus flowing into the respective passages 2A, 2B is collected through the respective communication ports 13*a*, 13*b* into the collecting chamber 12 and then discharged through the outlet pipe 14.

This embodiment also provides the effect common to the previously mentioned embodiments and, in addition, allows all the flat tubes 2 to be uniform in their lengths.

The eighth and final embodiment will be described.

Figure 16:
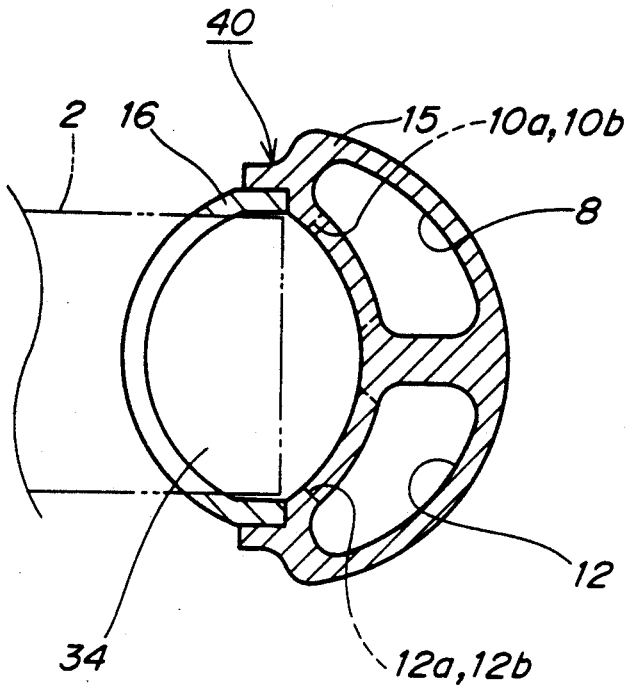
Figure 18:
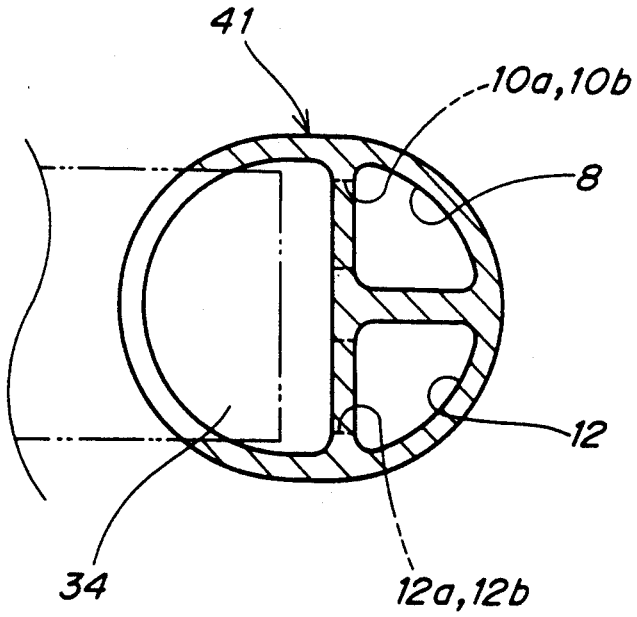
FIG. 18 is a transverse sectional view illustrating a variant of the header tank.
Figure 17:
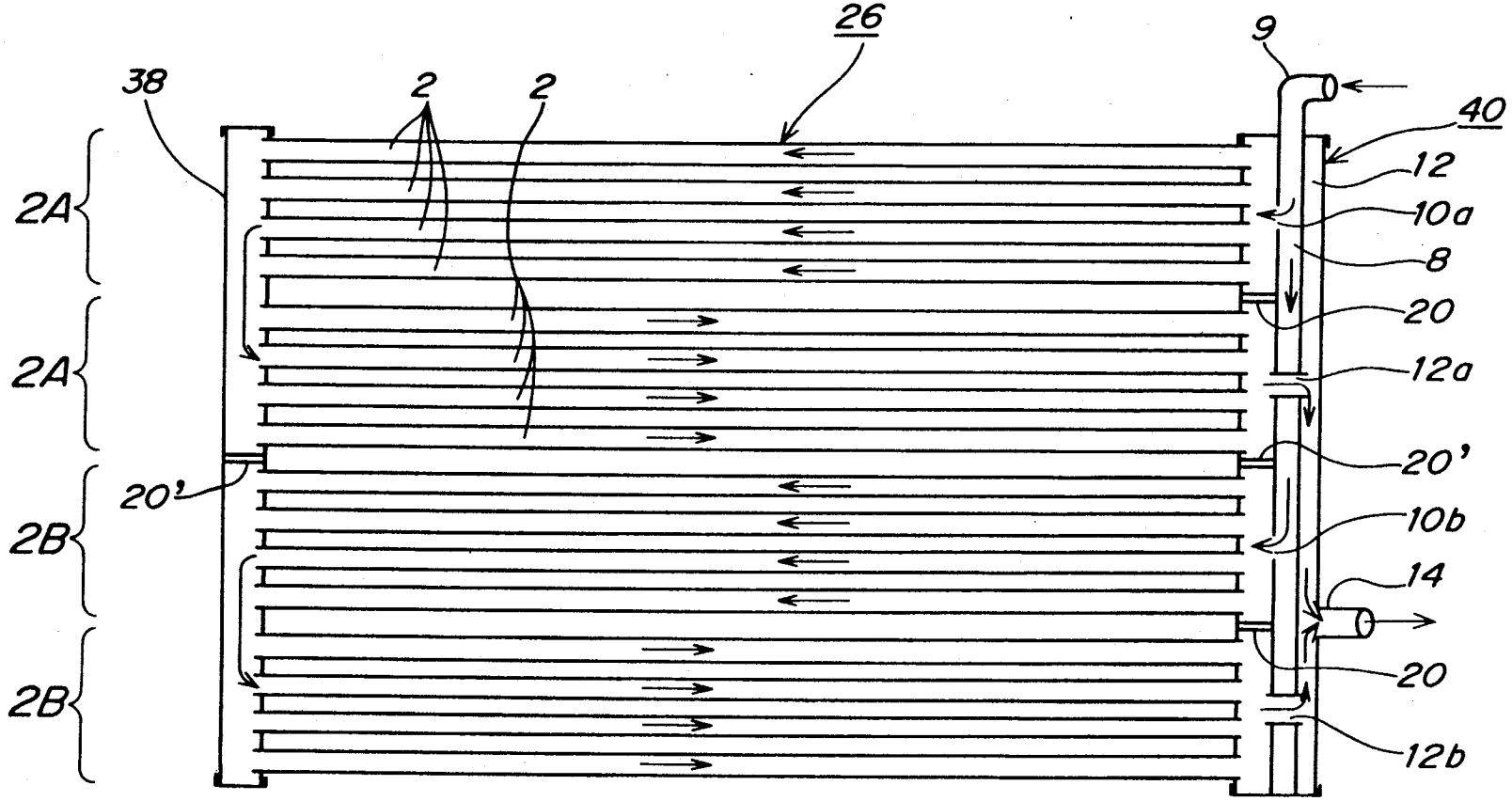

Referring to FIGS. 16 and 17, a header tank 40 in this embodiment comprises the diametrically divisible end plate 16 and tank 15 which cooperate with each other to define the main-passage 34, and a pair of sub-passages 8, 12 are formed within the tank 15. The sub-passage 8 serves as the distributing chamber and the other sub-passage 12 serves as the collecting chamber. It should be understood that the header tank may be obtained by extrusion so that three passages 34, 8, 12 are integrally formed within the header tank, as shown by FIG. 18.

Referring again to FIG. 17, the provision of partitions 20 and the communication ports 10*a*, 10*b*, 12*a*, 12*b* at desired locations allows refrigerant to flow through the pair of refrigerant passages 2A, 2B as indicated by arrows. This embodiment also allows all the flat tubes to be uniform in their lengths.

While the respective embodiments have been described and illustrated hereinabove as having a pair of refrigerant passages, it is obviously possible to employ three or more refrigerant passages without departure from the spirit and the scope of the invention.

What is claimed is:

1. A heat exchanger comprising:

a pair of header tanks placed in parallel to each other in a plane;

a row of parallel tubes placed in said plane and connected at opposite ends to said header tanks;

a plurality of partitions provided in said header tanks to divide each header tank into a plurality of compartment along the length of said header tank thereby forming a plurality of refrigerant passages each consisting of a plurality of multitube paths each having a plurality of said parallel tubes; and a pair of additional tanks each attached to each of said header tanks to form a chamber which communicates with said refrigerant passages through ports formed on said header tank whereby refrigerant is distributed into said plurality of refrigerant passages to provide reduced flow resistance.

2. The heat exchanger of claim 1, wherein said refrigerant passages comprise an upper refrigerant passage consisting of a plurality of said parallel tubes placed in an upper half of said heat exchanger and a lower refrigerant passage consisting of a plurality of said parallel tubes placed in a lower half of said heat exchanger.

3. The heat exchanger of claim 1, wherein said refrigerant passages each comprise a plurality of multitube paths, said multitube paths of one refrigerant passage being arranged side by side with multitube paths of another refrigerant passage.

4. A heat exchanger comprising:

a pair of header tanks placed in parallel to each other in a plane;

a row of parallel tubes placed in said plane and connected at opposite ends to said header tanks;

a plurality of partitions provided within said header tanks to divide each header tank into a plurality of compartments along the length of said each header tank thereby forming a plurality of refrigerant passages each consisting of a plurality of multitube paths each having a plurality of said parallel tubes; and a longitudinal partition provided within each of said header tanks to form a chamber separate from said plurality of partitions which communicates in parallel with said refrigerant passages through ports formed thereon whereby refrigerant is distributed into said plurality of refrigerant passages to provide reduced flow resistance.

5. The heat exchanger of claim 4, wherein said refrigerant passage comprises an upper refrigerant passage consisting of a plurality of parallel tubes placed in an upper half of said heat exchanger and a lower refrigerant passage consisting of a plurality of said parallel tubes placed in a lower half of said heat exchanger.

6. The heat exchanger of claim 4, wherein said refrigerant passages comprise a plurality of multitube paths, said multitube paths of one refrigerant passage being arranged side by side with multitube paths of another refrigerant passage.

7. A heat exchanger comprising:

a pair of header tanks placed in parallel to each other in a plane;

a row of parallel tubes placed in said plane and connected at opposite ends to said header tanks;

a plurality of partitions provided within said header tanks to divide each header tank into a plurality of compartments along the length of said header tank thereby forming a plurality of refrigerant passages each consisting of a plurality of multitube paths each having a plurality of said parallel tubes; and a plurality of inlet pipes each connected at one end to some of said refrigerant passages and at the other end to a distributor whereby refrigerant is distributed into said plurality of refrigerant passages to provide reduced flow resistance.

8. The heat exchanger of claim 7, wherein said refrigerant passages comprise an upper refrigerant passage consisting of a plurality of said parallel tubes placed in an upper half of said heat exchanger and a lower refrigerant passage consisting of a plurality of said parallel tubes placed in a lower half of said heat exchanger.

9. The heat exchanger of claim 7, wherein said refrigerant passages comprise a plurality of multitube paths, said multitube paths of one refrigerant passage being arranged side by side with multitube paths of another refrigerant passage.

* * * * *